US005388954A

United States Patent [19]

Marinoni et al.

[11] Patent Number: 5,388,954

[45] Date of Patent: Feb. 14, 1995

[54] UNIT FOR FEEDING SEMIFINISHED PARTS TO A FORMING MACHINE, PARTICULARLY A PRESS

[75] Inventors: Giorgio Marinoni, Turin; Arturo Baroncelli, Caraglio, both of Italy

[73] Assignee: Comau S.p.A., Grugliasco, Italy

[21] Appl. No.: 69,014

[22] Filed: May 28, 1993

[30] Foreign Application Priority Data

May 29, 1992 [IT] Italy ..... 92A000464

[51] Int. Cl.[6] ..... B65H 3/00

[52] U.S. Cl. ..... 414/795.7; 271/227; 271/238; 271/240; 271/255

[58] Field of Search ..... 271/227, 234, 236, 238, 271/240, 241, 253, 255, 162, 164, 171; 414/795.7

[56] References Cited

U.S. PATENT DOCUMENTS 4,162,641 7/1979 Stubbings .
4,245,830 1/1981 Fichte et al. ..... 271/164
4,524,601 6/1985 Bernardi .
4,971,311 11/1990 Tsukimoto ..... 271/227
5,076,562 12/1991 Sai et al. ..... 271/241 X
5,110,113 5/1992 Kanaya ..... 271/241

FOREIGN PATENT DOCUMENTS 2939267 4/1981 Germany ..... 271/171
0087148 5/1985 Japan ..... 271/236
0110428 4/1989 Japan ..... 414/795.7

*Primary Examiner*—H. Grant Skaggs
*Assistant Examiner*—Carol L. Oruzbick
*Attorney, Agent, or Firm*—Dvorak and Traub

[57] ABSTRACT

A unit for feeding semifinished parts, whereby a carriage travelling along a straight slideway supports a rectangular table in turn supporting a parallelepiped stack of semifinished parts and which is floatable by means of an air cushion. The carriage presents a device for positioning the stack and comprising four articulated arms, each fitted to the carriage and having, on its free end, a locating element designed to contact the lateral walls of the stack.

4 Claims, 2 Drawing Sheets

UNIT FOR FEEDING SEMIFINISHED PARTS TO A FORMING MACHINE, PARTICULARLY A PRESS

BACKGROUND OF THE INVENTION

The present invention relates to a unit for feeding semifinished parts to a forming machine, particularly a press.

Known feed units of the aforementioned type comprise a loading station in which a stack of semifinished parts is loaded on to a carriage; and an unloading station in which the parts are gripped and withdrawn one by one off the stack by a handling device and fed on to the press.

The efficiency of known units of the aforementioned type depends on the accuracy with which the stack is positioned on the carriage, any errors in which affect the pickup position of the handling device in relation to the part.

To overcome the above drawback, self-adjusting devices are provided for determining the position of the stack in relation to the carriage by means of a number of sensors connected to a processing unit, which recalculates the zero position of the handling robot to compensate for any error in the position of the stack.

In addition to the complex design and, hence, high cost involved, such devices are also difficult to regulate.

SUMMARY OF THE INVENTION

It is an object of the present invention to provide a semifinished part feed unit enabling straightforward, correct positioning of the stack.

According to the present invention, there is provided a unit for feeding semifinished parts to a forming machine, particularly a press, and comprising loading means for supporting a substantially neat stack of said semifinished parts;

said loading means moving between at least a loading station and an unloading station featuring gripping means for withdrawing said semifinished parts one by one; characterized by the fact that said loading means comprise a carriage, and a table for supporting said stack;

said unit also comprising means for positioning said stack in relation to said carriage.

According to the present invention, there is also provided a method of positioning a substantially neat stack of semifinished parts supported on a table in turn supported on a carriage in a unit for feeding semifinished parts to a forming machine, particularly a press; characterized by the fact that it comprises:

a first stage wherein a reference body is positioned on said table;

a second stage wherein a positioning device, comprising at least three arms with locating ends, is positioned with said ends contacting the walls of said reference body;

a third stage wherein the positions of said ends in relation to said carriage are memorized;

a fourth stage wherein said articulated arms are withdrawn from said reference body, and said reference body is removed from said table;

a fifth stage wherein a stack of semifinished parts is placed on said table, and the table is rendered floating;

a sixth stage wherein said articulated arms are brought up to said stack, and said ends are set to the same position measured previously in relation to said carriage;

a seventh stage wherein said stack is positioned manually by moving said table, and its walls are positioned contacting said ends;

an eighth stage wherein the supporting device is deactivated, and said table is rendered integral with said carriage.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
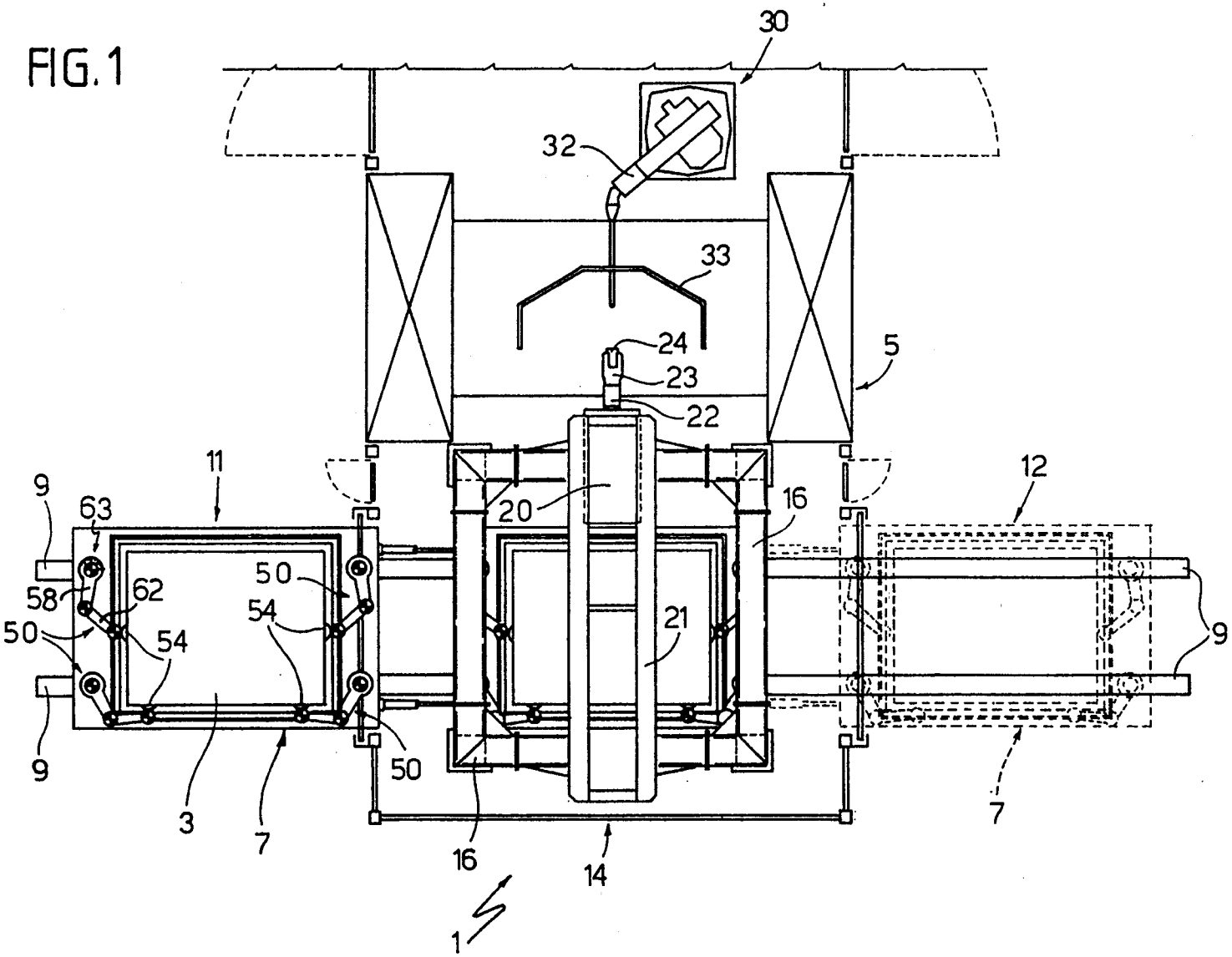
FIG. 1 shows a partial plan view of a preferred embodiment of a unit for feeding semifinished parts to a press in accordance with the present invention.

Number 1 in FIG. 1 indicates a unit for feeding semifinished parts 3, conveniently flat rectangular sheets arranged one on top of the other, to a press 5 (shown schematically).

Feed unit 1 comprises two slides 7 running back and forth, along a straight slideway 9, between first and second diametrically-opposed loading stations 11, 12, wherein slides 7 are illustrated respectively by continuous and dotted lines; and an unloading station 14 located halfway along slideway 9 between stations 11 and 12.

Unloading station 14 is located opposite press 5, and comprises a metal frame 16 supporting a gripping robot 20 travelling along a straight slideway 21 over slideway 9. Robot 20 presents an articulated gripping arm 22 (shown partially in FIG. 1) terminating in a gripping head 23 with a suction cup 24 for gripping parts 3 one by one off slide 7 and feeding them on to press 5.

FIG. 1 also shows an unloading robot 30 located to the side of press 5, on the opposite side to unloading station 14, and having a movable arm 32 terminating in a gripping fork 33 for gripping and withdrawing pressed parts 3 off press 5.

Figure 2:
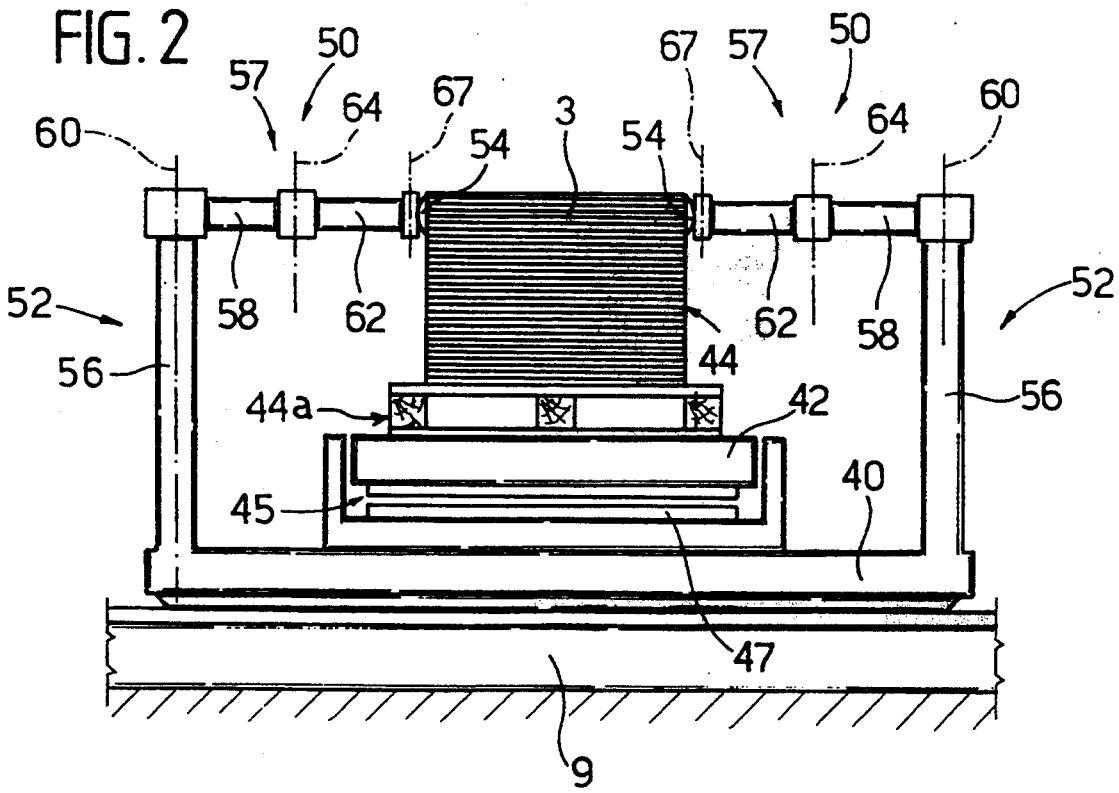
FIG. 2 shows a partial side view of the FIG. 1 feed unit.

As shown in FIG. 2, each slide 7 comprises a rectangular carriage 40 running along slideway 9 and supporting a rectangular table 42 in turn supporting a parallelepiped stack 44 of parts 3 on a pallet 44*a*. Slides 7 present a pneumatic device 45 for temporarily supporting table 42 and comprising a number of nozzles 47 on the upper surface of carriage 40 for blowing compressed air on to the wall of table 42 facing carriage 40, and so raising table 42.

Each slide 7 also presents a device 50 for positioning stack 44 in relation to carriage 40 and comprising four elements 52 fitted in twos along opposite straight edges of carriage 40.

Each element 52 comprises a vertical supporting column structure 56 extending perpendicular to carriage 40 and fitted on the top end with an articulated arm 57 perpendicular to structure 56 and extending towards stack 44.

Each articulated arm 57 comprises a first arm 58 movable angularly about a vertical axis 60 in relation to structure 56, and connected in angularly-movable manner to a first end of a second arm 62. Arm 62 rotates about a vertical axis 64 in relation to arm 58, and is fitted on its second free end with a locating element 54 pivoting about a vertical axis 67 in relation to arm 62. Elements 54 are defined by a flat locating surface (not shown) positionable tangent to the walls of stack 44, as described later on.

Figure 3:
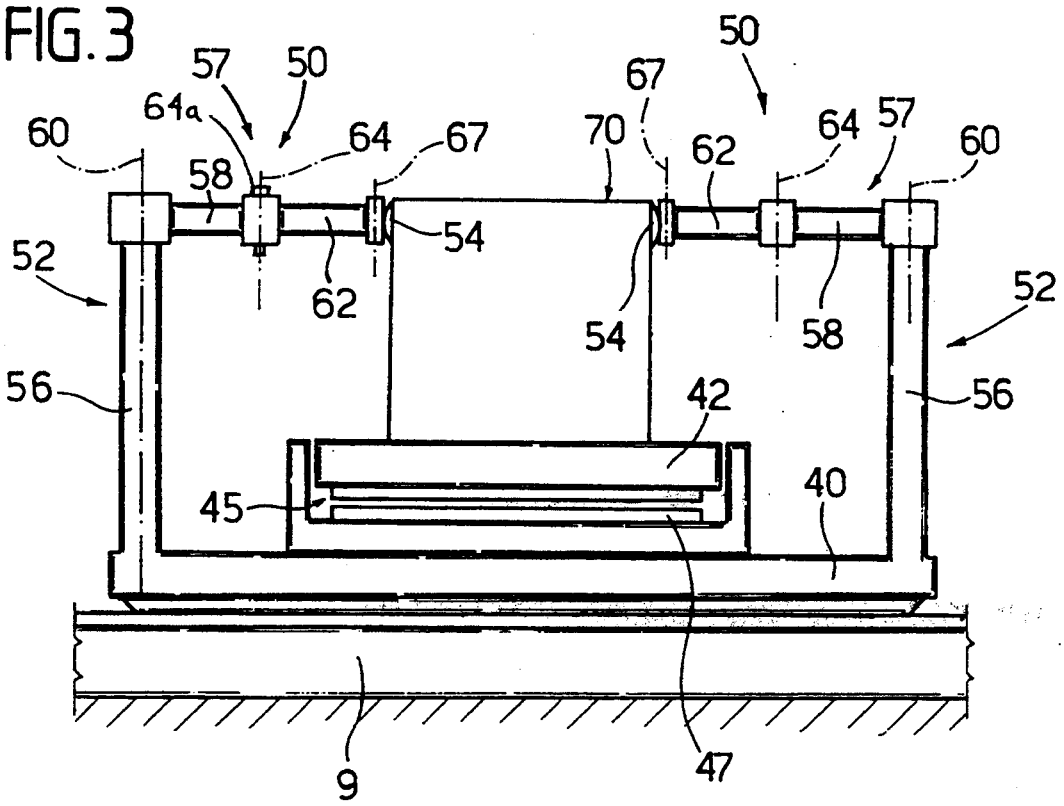
FIG. 3 shows a partial side view of the FIG. 1 feed unit in a different operating position.

Prior to use, device 50 is subjected to a setting operation wherein (FIG. 3) a reference body (model) 70 of the same size as stack 44 of parts 3 is placed on table 42. Body 70 is set in relation to carriage 40 (in known manner, e.g. by means of locating elements) to a given reference position ensuring correct unloading of parts 3 in station 14.

Positioning device 50 is then adjusted manually, and arms 57 are rotated to position the locating surfaces of elements 54 tangent to the walls of body 70, by rotating arms 58 and 62 about respective axes 60 and 64. When elements 54 are all positioned contacting body 70, arms 58 are made integral with respective arms 62 for example, by inserting a locking pin 64*a*, and the angular position of the four arms 58 in relation to respective structures 56 is measured by means of a graduated scale 63 on structure 56 (FIG. 1).

Articulated arms 57 are then withdrawn from body 70 by rotating them about axis 60, and body 70 is removed from table 42, at which point, positioning device 50 is ready for use.

Stack 44 is then placed on table 42, which is subsequently raised and rendered floating by activating pneumatic device 45.

At this point, articulated arms 57 are moved up to stack 44, and arms 58 (integral with arms 62) are set to the same angular position measured previously in relation to structure 56, so that elements 54 are all set to the same position as at the setting stage in relation to carriage 40.

Stack 44 is then moved manually, by displacing floating table 42, until the lateral walls of stack 44 are positioned tangent to all of elements 54, in which position, stack 44 is set to the reference position in relation to carriage 40. At this point, pneumatic device 45 is deactivated and table 42 lowered on to carriage 40.

The feed unit according to the present invention thus provides, in an extremely straightforward manner, for positioning stack 44 of parts 3 in relation to carriage 40 and, hence, in relation to unloading station 14.

To those skilled in the art it will be clear that changes may be made to the feed unit as described and illustrated herein without, however, departing from the scope of the present invention.

We claim:

1. A method of positioning a substantially neat stack of semifinished parts supported on a table which is supportable on a carriage in a unit for feeding the semifinished parts to a forming machine, the method comprising steps of:

positioning a reference body having side walls on the table;

positioning a positioning device, comprising at least three arms with locating ends, so that the ends of the arms contact the walls of the reference body;

memorizing the positions of the ends in relation to the carriage;

withdrawing the arms from the reference body, and removing the reference body from the table;

disposing a stack of semifinished parts on the table, and floating the table;

moving the arms up to the stack, and setting the ends of the arms to the memorized position relative to the carriage:

positioning the stack by moving the table so that the stack contacts the ends of the arms; and deactivating the support device and rendering the table integral with the carriage.

2. In an apparatus for feeding semifinished parts to a forming machine, the apparatus comprising a table for supporting a stack of the semifinished parts, a carriage movable between a loading station and an unloading station having gripping means for withdrawing one of the semifinished parts from the stack, air cushion supporting means for floating the table in relation to the carriage, and locating means for positioning the table supporting the stack of semi-finished parts relative to the carriage, the improvement comprising:

at least three support members extending from the carriage;

an articulated arm extending from each support member, each articulated arm having a first portion with a first distal end extending from and movable in relation to the support member, a second portion with a second distal end extending from and movable in relation to the first distal end, and an adjustable end portion extending from and movable in relation to the second distal end, the adjustable end portion contactable with sides of the stack; and means for memorizing the position of the articulated arms in relation to the carriage.

3. In the apparatus of claim 2, wherein the articulated arm is rotatable about an axis of the support member, the memorizing means comprising;

a graduated scale interposing the support member and the first portion of the articulated arm, the graduated scale indicating a position of the first portion of the articulated arm in relation to the support member; and a locking pin interconnecting the distal end of the first portion of the articulated arm and the second portion of the articulated arm, the locking pin fixing the first portion of the articulated arm in relation to the second portion of the articulated arm.

4. In the apparatus of claim 2 wherein the adjustable end portion is pivotable in relation to the second distal end of the second portion of the articulated arm, the end portion having a substantially flat surface that is contactable with sides of the stack by pivoting the adjustable end portion so that the articulated arm may accurately position a stack of any shape relative to the carriage.

* * * * *

UNITED STATES PATENT AND TRADEMARK OFFICE

CERTIFICATE OF CORRECTION

PATENT NO. : 5,388,954

DATED : February 14, 1995

INVENTOR(S) : Marinoni, Giorgio; Baroncelli, Arturo

It is certified that error appears in the above-identified patent and that said Letters Patent is hereby corrected as shown below:

On the title page: Item [30]:

The Italian Patent Application number currently reads "92A000464". It should read:

--T092A0464--

Signed and Sealed this

Eighth Day of September, 1998

*Attest:*

Bruce Lehman

BRUCE LEHMAN

*Attesting Officer*

*Commissioner of Patents and Trademarks*